United States Patent [19]

Tochizawa

[11] 4,290,039

[45] Sep. 15, 1981

[54] AC SOLENOID APPARATUS OF THE ARMATURE IN TUBE TYPE

[75] Inventor: Ikuo Tochizawa, Takaoka, Japan

[73] Assignee: Kabushiki Kaisha Fujikoshi, Toyama, Japan

[21] Appl. No.: 87,487

[22] Filed: Oct. 23, 1979

[30] Foreign Application Priority Data

Oct. 26, 1978 [JP] Japan ..... 53-130991

[51] Int. Cl.[3] ..... H01F 7/08

[52] U.S. Cl. ..... 335/262; 335/251

[58] Field of Search ..... 335/251, 244, 243, 262, 335/255

[56] References Cited

U.S. PATENT DOCUMENTS 3,633,139 1/1972 Thompson ..... 335/255

4,142,169 2/1979 Katchka et al. ..... 335/243

*Primary Examiner*—Harold Broome

*Attorney, Agent, or Firm*—Spencer & Kaye

[57] ABSTRACT

An AC solenoid apparatus of the armature-in-tube type for operating valves such as hydraulic/air valves, or other machines. The apparatus comprises a solenoid having a sealingly closed part including a pressure proof tube preferably made from a thin nonmagnetic material, and an exciting assembly having a coil encompassing the closed part and a yoke having a generally rectangular cross section. A slotted annular magnetic ring made from a magnetic material is inserted between the pressure proof tube and at least one part of the yoke. The solenoid of this invention is small in size and of low cost, and yet is endowed with a high force and a capability of restraining heat by being generated from the solenoid.

4 Claims, 4 Drawing Figures

AC SOLENOID APPARATUS OF THE ARMATURE IN TUBE TYPE

BACKGROUND OF THE INVENTION

This invention relates to an AC solenoid apparatus for operating valves, such as hydraulic/air valves, or other machines. More particularly it relates to an improved AC solenoid of the so-called armature-in-tube type including an armature for moving a valve spool. The armature is immersed in oil to enable movement freely in the axial direction and further, has a tubular pressure proof part which forms an oil-tight seal to the outside. Prior art AC solenoids of the armature-in-tube type are shown in U.S. Pat. No. 3,633,139. In such prior art AC solenoids, since the armature is kept immersed in oil, there is need to seal off this portion with a pressure proof tube. This pressure proof tube has to be constructed, at least partially, of a nonmagnetic material because of the necessity for providing a magnetic path. In most cases, the whole tube is made from nonmagnetic material. In such a case the magnetic reluctance increases and the solenoid performance is significantly debased, resulting in the generation of only a weak operating force.

In the solenoid disclosed in U.S. Pat. No. 3,633,139, an exciting assembly comprising a coil and yoke provides the magnetic path. The pressure proof tube, which is contacted on its outer circumferential surface by the yoke, is subjected to a thermal treatment which places it in a magnetic state at those portions where it contacts the yoke and in a magnetic condition between those portions. Alternatively, a non-magnetic element may be welded at the intermediate portion.

However, such thermal treatment is complicated and there is a possibility that an undesirable effect will be produced around the boundary face between the magnetic and nonmagnetic materials and, when the welding technique is used, the thickness of the tube must be increased. The thermal treatment causes eddy currents to increase and both methods are expensive because, for example, it is necessary to grind the inner faces of both thermally-treated and welded tubes. Also, since no slot can be provided in the portion made from magnetic material, eddy currents are generated. The prior art solenoids have the disadvantage mentioned above.

SUMMARY OF THE INVENTION

It is a principal object of the present invention to overcome the disadvantages inherent in the above-described types of prior art solenoids. It is another object of the present invention to enhance and improve the solenoid characteristics including the magnetic force, etc. by minimizing drastically the magnetic reluctance especially at a portion contacting a yoke serving as the magnetic path of an exciting assembly. A further object of the present invention is to provide a solenoid of the armature-in-tube type which is small in size and of low cost. It is still another object of the present invention to provide a solenoid having a yoke with superb magnetic characteristics.

These objects are attained by an AC solenoid apparatus of the armature-in-tube type used for operating valves such as hydraulic/air valves, or other machines, including a sealingly closed part having a pressure proof tube, an armature slidingly moving in contact with the inside face of the pressure tube, a stationary core secured to the end of the pressure proof tube and having an axial bore enabling circulation of oil between a fluid passage of the valve attached to the solenoid and the interior of the pressure proof tube, an end member sealingly fixed to the other end of the pressure proof tube and a pin passing through the axial bore and at the same time engagable with the armature. The apparatus further includes an exciting assembly having a coil encompassing the closed part for movement of the armature axially when current flows in the coil and a yoke enclosing the coil having a generally rectangular and tubular cross section and two openings preferably made at the centers of both longitudinal side faces. The yoke is further formed with two slots at each of the longitudinal side faces which lead respectively to each of the openings. The pressure proof tube is preferably made from a thin nonmagnetic material. Between the pressure proof tube and at least one opening of the yoke and at the contacting face thereof, a magnetic ring is inserted. The magnetic ring, which is made from an annular magnetic material, includes a slot and has a larger axial length than the thickness of the yoke. The ring is inserted with the slot oriented vertically and conforming to the slots in the yoke.

In one embodiment of this invention, the yoke is preferably constructed of silicon steel sheet in a wound configuration having a substantially rectangular coil window or by forming the yoke of a magnetic sintered metal.

BRIEF DESCRIPTION OF THE DRAWINGS

The present invention will be more fully understood by reference to the following detailed description thereof, when read in conjunction with attached drawings wherein like reference numerals refer to like elements and wherein.

DETAILED DESCRIPTION OF THE PREFERRED EMBODIMENTS

Figure 1:
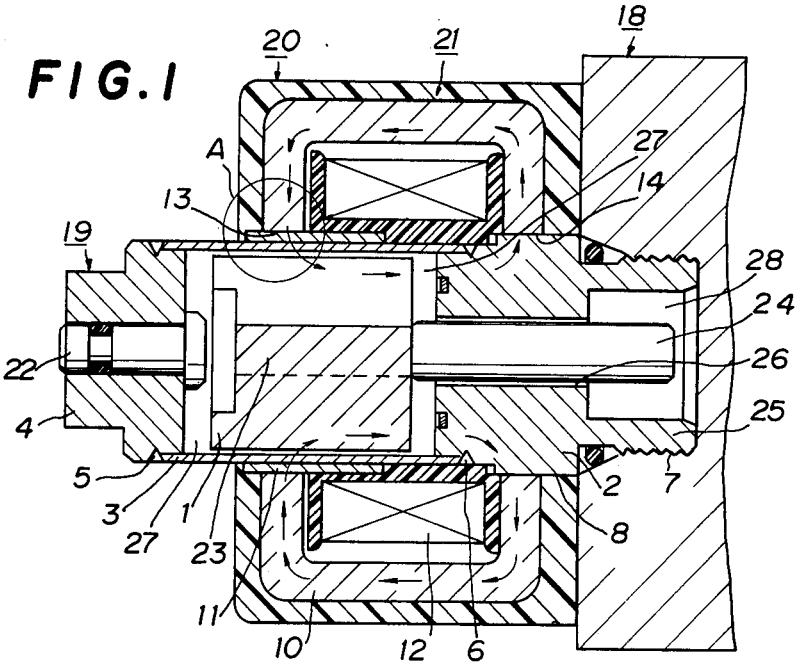
FIG. 1 is a cross-sectional view of a solenoid of an embodiment of the present invention taken along the longitudinal center of the yoke.

As viewed in FIG. 1, a solenoid (20) substantially comprises a sealingly closed part (19) and an exciting assembly (21) both adapted for attachment to a valve (18) with screws, etc. to permit removal of the solenoid whenever necessary. The exciting assembly (21) includes a coil (12), yoke (10), magnetic ring (11), material interconnecting the above-mentioned parts, e.g. resin, and lead wires and terminals (not shown) connecting the AC power source (not shown) to the coil (12). The coil (12) is well known and therefore need not be described in detail herein.

Figure 2:
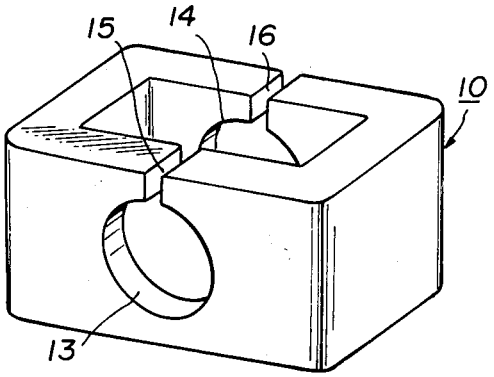
FIG. 2 is a perspective view of the yoke of FIG. 1.
Figure 3:
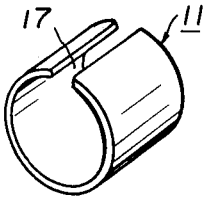
FIG. 3 is a perspective view of the magnetic ring shown in FIG. 1.
Figure 4:
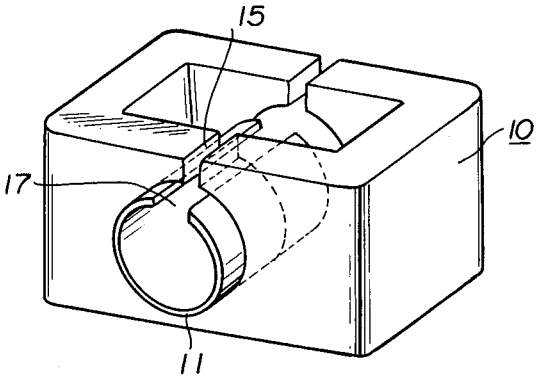
FIG. 4 is a perspective view showing the assembled yoke and magnetic ring of FIG. 1.

The yoke (10), as shown in FIG. 2, is a tubular element with a thick rectangular cross-section having at the center of longitudinal sides a pair of concentric circular openings (13) and (14) with slots (15) and (16) connecting the circular openings (13) and (14) with the outside of the yoke. The slots (15) and (16) are provided to prevent circumferential eddy current in the vicinity of the circular openings (13) and (14). A stationary core (2) is directly fitted and fixed within the circular opening (14). A magnetic ring (11), made from an annular magnetic material having a slot (17) forming axial cut faces, as shown in FIG. 3, and having a longer axial length than the thickness of the yoke (10), is fitted fixedly within the circular opening (13). The slot (15) and the slot (17) are aligned with each other vertically.

The inner surface of the magnetic ring (11) is fitted closely to the outer circumferential surface of a pressure-proof tube (3). The yoke (10) used in the embodiment of the present invention is preferably constructed of silicon steel sheet in a wound configuration having a substantially rectangular coil window or, by forming the yoke of magnetic sintered metal.

The coil (12) is placed fixedly between the yoke (10) and the magnetic ring (11), and the closed part (19) provides a magnetic path for exciting an armature (1), as shown by the arrows in FIG. 1.

The closed part (19) is provided with a nonmagnetic thin pressure proof tube (3), an armature (1) making sliding movement in contact with the inner surface of the pressure proof tube (3) and a pin (24) secured to the armature (1) at a small diameter portion (23) (the pin may be not secured). The closed part (19) is further provided with a stationary core (2) sealingly secured to the end of the pressure proof tube (3) by a welded part (6). An axial bore (not shown) is located within the armature to allow oil to circulate between the opposite oil chambers (27) and (27), and an axial bore (26) allows circulation of oil between a fluid passage (28) and chamber (27). An end member (4) forming a portion of closed part (1*a*) is sealingly secured to the other end of the pressure proof tube (3) with a welded part (5) to prevent oil from leaking to the outside, and a manual-operated pin (22), which is used for pushing the armature (1) by hand, is also provided. Also, the pin (24) connected fixedly to the armature (1) is disposed through the axial bore (26) of the stationary core (2).

The stationary core (2) has an extension (25) and a thread (7) on its outer circumferential surface in the vicinity of its end. The valve (18) is threaded onto the core by rotating the stationary core (2).

The solenoid (20) operates the valve (18) by the projecting motion of the pin (24) pushing a spool (not shown) of the valve (18) which is coaxial with the pin (24) to the right, with the solenoid being kept secured to the valve (18) such as hydraulic/air valves.

Hereunder, there is given a detailed description of the operating condition. At the position shown in FIg. 1, the exciting assembly (21) is in its unenergized position. When current is caused to flow in the coil (12) from an AC power source (not shown) via lead wires and terminals to energize the exciting assembly (21), magnetic lines of force shown by the arrows in FIG. 1 are generated which move the armature (1) to the right, i.e. toward the stationary core (2), thereby pushing the pin (24) to transfer the spool (not shown) of the valve (18) and change the valve position. The moment this current is cut off, the abovementioned magnetic lines of force vanish and the armature comes to a stop. Alternatively the aforesaid spool may be pushed to the left by a spring (not shown) or a solenoid at the opposite side may thrust the pin (24) and the armature (1) toward the left causing the armature to return to the original position indicated in FIG. 1 of the drawing.

The strength of the magnetic lines of force of the solenoid generated when the aforementioned exciting assembly (21) has been increased is much greater than that of prior art solenoids. This is because first of all the pressure proof tube (3) is no longer required to support the exciting assembly (21); rather, support is achieved by use of a thread (not shown) cut between the periphery of the circular opening (14) and the stationary core (2) and the tube can be made just thick enough to withstand the pressure of the oil in chamber (27) communicating with the fluid passage (28). Thus, a tube considerably reduced in thickness can be used and the result is that the magnetic reluctance is small and eddy currents are decreased as well. Secondly, since the stationary core (2) is kept fitted directly to the circular opening (14), the magnetic reluctance at the contacting face is very low.

Thirdly, the magnetic reluctance at the periphery of the opening (13), is decreased, which is a most important point to be noted. Namely, the magnetic reluctance across ordinary nonmagnetic materials is proportional to the thickness of the nonmagnetic material and inversely proportional to the sectional area of the magnetic path. Consequently, as to the portion A, assuming the sectional area of the magnetic path at the opening (13) is $S_O$, the sectional area of the magnetic path at the magnetic ring (11), is $S_1$, the thickness of the nonmagnetic part of the pressure proof tube (3) is t and the permeability is $\mu$, the magnetic reluctance $Rm_1$ in the case where the magnetic ring (11) is not used is as follows:

$$Rm_1=(t/\mu S_o) \quad (1)$$

$Rm_1$ reduces when $S_o$ is increased and for increasing $S_o$, the solenoid volume would have to be enlarged. However, a restriction is put on increasing the volume in terms of the construction and at the same time, the cost of manufacture is also raised.

In contrast, the magnetic reluctance $Rm_2$ when using the magnetic ring (11) is as follows:

$$Rm_2=(t/\mu S_1) \quad (2)$$

Since $S_1$ may be three to four times as much as $S_o$, the magnetic reluctance when the magnetic ring (11) is used is less than half that obtained when the ring is not used. Further the magnetomotive force consumed in this portion is small, thus enhancing and improving the solenoid characteristics including the magnetic force and at the same time making it possible to decrease the solenoid volume.

Furthermore, the yoke (10) is substantially constructed of silicon steel sheet in a wound configuration having a substantially rectangular coil window or by forming the yoke of the magnetic sintered metal thereby obtaining superior magnetic characteristics. Also, the magnetic ring (11) and the yoke (10) contain the slot (17) and the slots (15) and (16) wherein the cut faces are kept separate from each other. And, the slot (17) and the slot (15) are in registration with each other vertically thereby restraining the generation of eddy currents in a circumferential direction as much as possible in the vicinity of the magnetic ring (11) and the circular opening (13) of the yoke (10). As a result, the solenoid is prevented from being heated unnecessarily, thus further improving the solenoid characteristics.

As described above, the solenoid of the present invention is compact in size, and yet is endowed with superior characteristics. In addition, there is no need to give the pressure proof tube a special heat or welding treatment, nor give a subsequent grinding treatment to the interior and exterior of the tube thereby achieving low cost apparatus which is very useful.

A push-type AC solenoid has been described wherein the push pin of the solenoid pushes a spool to accomplish the change-over of a valve. However, it will be understood by those skilled in the art that this invention would also be applicable to a pull-type solenoid wherein the pull pin of the solenoid pulls a spool to accomplish the change-over of the valve. Therefore in this invention the term "solenoids" includes pull-type AC solenoids.

Although preferred embodiments of the invention have been described in considerable detail for illustrative purposes, many changes or modifications may be done without departing from the scope of the appended claims. It is therefore desired that the protection afforded by Letters Patent be limited only by the true scope of the appended claims.

What is claimed is:

1. An AC solenoid apparatus for operating a valve comprising:

a relatively thin pressure proof tube made from non-magnetic material, said tube having a longitudinal axis;

an armature slidably positioned within said tube for movement along said longitudinal axis in contact with the inner face of said tube;

a stationary core secured to one end of said pressure proof tube, said core having an axial bore along which oil can circulate between said valve and the interior of said pressure proof tube;

an end member sealingly attached to the other end of said pressure proof tube;

a pin positioned within the axial bore of said stationary core and engageable with said armature; and an exciting assembly including;

a coil surrounding said pressure proof tube, said armature moving axially within said tube when said coil is energized by current flowing therethrough;

a generally rectangular yoke having a pair of longitudinal side faces with openings therein surrounding said coil, said yoke having slots in each of said longitudinal side faces connecting said openings with the outside of said yoke; and a slotted annular ring made from magnetic material, said ring being interposed between said pressure proof tube and at least one opening of said yoke, the slot in said ring being in alignment with a slot in said yoke, said ring having an annular length greater than the thickness of said yoke.

2. An AC solenoid apparatus according to claim 1, wherein said pressure proof tube and said magnetic ring are fitted within one circular opening of said yoke and said stationary core is fitted directly within the other circular opening of said yoke.

3. An AC solenoid apparatus according to claim 1, wherein said yoke is constructed of silicon steel sheet in a wound configuration, said yoke having a substantially rectangular coil window.

4. An AC solenoid apparatus according to claim 1 wherein said yoke is comprised of magnetic sintered metal.

* * * * *